US009603201B2

(12) United States Patent
Bogel et al.

(10) Patent No.: US 9,603,201 B2
(45) Date of Patent: Mar. 21, 2017

(54) METHOD FOR TRANSMITTING DATA, INDUCTION HEATING DEVICE, INDUCTIVELY HEATABLE COOKING VESSEL AND SYSTEM

(71) Applicant: E.G.O. Elektro-Gerätebau GmbH, Oberderdingen (DE)

(72) Inventors: Jorg Bogel, Oberderdingen (DE); Michael Eberle, Oberderdingen (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 728 days.

(21) Appl. No.: 13/712,554

(22) Filed: Dec. 12, 2012

(65) Prior Publication Data

US 2013/0153564 A1 Jun. 20, 2013

(30) Foreign Application Priority Data

Dec. 16, 2011 (DE) ..... 10 2011 088 918

(51) Int. Cl.
*H05B 6/12* (2006.01)
*H05B 6/10* (2006.01)
*H05B 6/06* (2006.01)

(52) U.S. Cl.
CPC ..... *H05B 6/06* (2013.01); *H05B 6/062* (2013.01); *H05B 2213/06* (2013.01)

(58) Field of Classification Search
CPC ..... H05B 6/12; H05B 6/10
USPC ..... 219/620–632, 702, 720; 99/325
See application file for complete search history.

(56) References Cited

U.S. PATENT DOCUMENTS

| | | | | |
|---|---|---|---|---|
| 3,742,178 | A * | 6/1973 | Harnden, Jr. | 219/627 |
| 3,836,744 | A * | 9/1974 | Taketo et al. | 219/620 |
| 6,320,169 | B1 * | 11/2001 | Clothier | 219/626 |
| 6,953,919 | B2 * | 10/2005 | Clothier | 219/620 |
| 7,157,675 | B2 * | 1/2007 | Imura | 219/627 |
| 8,606,180 | B2 * | 12/2013 | Santinato et al. | 455/41.2 |
| 2007/0080158 | A1 | 4/2007 | Takimoto | |
| 2009/0194526 | A1 * | 8/2009 | Buchanan | 219/600 |

FOREIGN PATENT DOCUMENTS

| | | | |
|---|---|---|---|
| DE | 19502935 | | 8/1996 |
| DE | 102008054911 | A1 * | 6/2010 |
| EP | 1708545 | A2 | 10/2006 |

(Continued)

OTHER PUBLICATIONS

English translation of DE102008054911A1 to Bally, published Jun. 2010.*

(Continued)

*Primary Examiner* — Michael Laflame, Jr.
(74) *Attorney, Agent, or Firm* — Lee & Hayes, PLLC

(57) ABSTRACT

The disclosure herein provides for transmitting data from an induction heating device to a receiver of an inductively heatable cooking vessel. The induction heating device may include a resonant circuit with an induction heating coil and a converter that may generate a control voltage (UA) from an AC mains voltage (UN) with a control frequency. The resonant circuit may be applied with a control voltage in order to generate an alternating magnetic field for heating the cooking vessel. The data to be transmitted to the receiver may be encoded using the the control frequency.

15 Claims, 2 Drawing Sheets

(56) References Cited

FOREIGN PATENT DOCUMENTS

WO WO 2013/014090 1/2013

OTHER PUBLICATIONS

English translation of EP0725556 to Bogdanski, published Aug. 1996.*
German Office Action dated Jul. 30, 2012 in DE 10 2011 088 918.3.
European Search Report dated Dec. 13, 2013 in European Application No. EP 12 19 6863.

* cited by examiner

METHOD FOR TRANSMITTING DATA, INDUCTION HEATING DEVICE, INDUCTIVELY HEATABLE COOKING VESSEL AND SYSTEM

CROSS REFERENCE TO RELATED APPLICATIONS

This application claims the benefit of German patent application DE 10 2011 088 918.3, filed on Dec. 16, 2011, the contents of which are incorporated by reference for all that it teaches.

FIELD

The disclosure relates to a method for transmitting data from an induction heating device to a receiver of an inductively heatable cooking vessel, and corresponding induction heating device, inductively heatable cooking vessel, and system.

BACKGROUND

The not pre-published DE 10 2011 079 689 describes a method for transmission of data of a sensor, which is assigned to an inductively heatable cooking vessel, to a reading device which can be part of a converter. The converter can conventionally be provided for generation of a control voltage for an induction heating coil.

SUMMARY

The disclosure herein provides a method for transmitting data from an induction heating device to a receiver of an inductively heatable cooking vessel, an induction heating device, an inductively heatable cooking vessel and a system that optimizes a data exchange. According to one aspect, a method for transmitting data from an induction heating device to a receiver of an inductively heatable cooking vessel may include utilizing a converter of an induction heating device to generate a control voltage from an AC mains voltage with a control frequency. A resonant circuit of the induction heating device may include an induction heating coil and be applied with the control voltage in order to generate an alternating magnetic field for heating the inductively heatable cooking vessel. Data to be transmitted to the receiver may be encoded by means of the control frequency.

According to another aspect, an induction heating device includes a resonant circuit with an induction heating coil and a converter. The converter may generate a control voltage from an AC mains voltage with a control frequency. The resonant circuit may be applied with the control voltage in order to generate an alternating magnetic field for heating the cooking vessel. The data to be transmitted to the receiver may be encoded via the control frequency. An induction heating system may include the induction heating device, as well as an inductively heatable cooking vessel having a receiver configured for analyzing the control frequency to decode the data.

Said features and further features arise not only from the claims but also from the description and the drawings, wherein the individual features can be embodied in each case as one or more together in sub-combinations of an embodiment of the disclosure and in other fields and can be advantageous and capable of being protected on their own for which hereby protection is claimed. The division of the application into individual sections as well as cross headings does not limit the general validity of the contents thereof.

BRIEF DESCRIPTION OF THE DRAWINGS

In the following, the disclosed features are described with reference to the drawings representing preferred embodiments. In the drawings.

DETAILED DESCRIPTION

Figure 1:
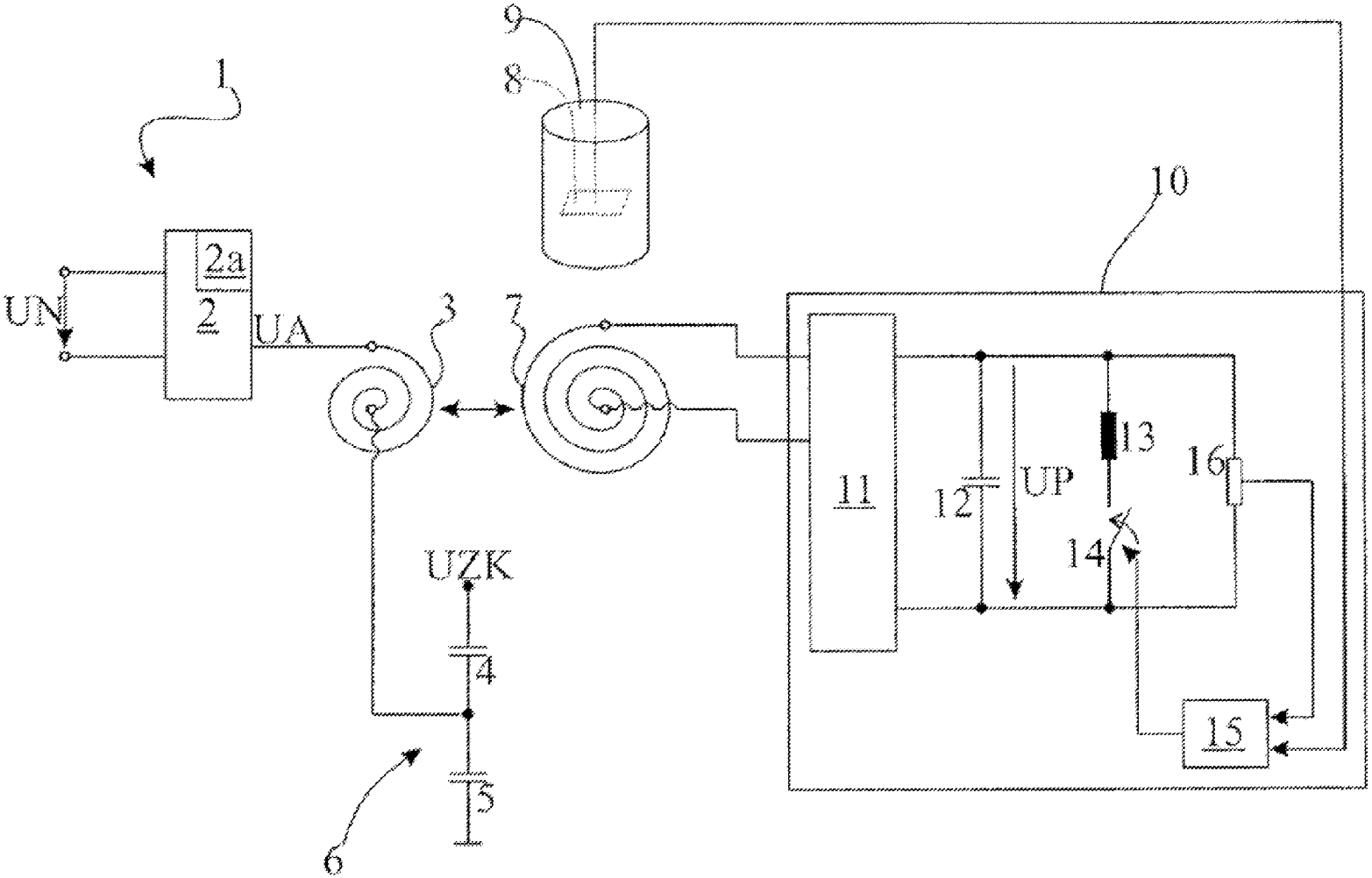
FIG. 1 schematically shows a system comprising an induction heating device and an inductively heatable cooking vessel, and FIG. 2 schematically shows a chronological sequence of a current flowing through an induction heating coil as occurring with a data transmission.

The disclosure herein may be used for transmitting or sending data from an induction heating device to an associated receiver of an inductively heatable cooking vessel. The receiver can be formed as an electrical circuit arranged at a suitable location of the cooking vessel. According to the various embodiments, the induction heating device may include: a resonant circuit having an induction heating coil and a (frequency) converter which generates a control voltage from an alternating current (AC) mains voltage with at least one control frequency, wherein the resonant circuit is applied with the control voltage in order to generate an alternating magnetic field for heating the cooking vessel. The data to be transmitted to the receiver may be encoded by means of the control frequency. Since the already existing elements of the converter are (also) used for data transmission, an additional dedicated transmitter can be dispensed with, facilitating data transmission in the direction of the cooking vessel or receiver respectively, which can be realized by simple and cost-efficient means.

The control frequency can be modified for encoding the data to be transmitted to the receiver. To that end, the control frequency can be modified in a scope of 0.1% to 5% with respect to a base frequency, for example. The base frequency can be in a range of 20 kHz to 50 kHz. Due to the minor change of the base frequency, the generated heating capacity is substantially not affected and disturbing, audible interferences between different cooking zones of the induction heating device are avoided.

The encoding of different data values can be effected by predefined, different frequency values. If, for example, the data is transmitted as a binary code, for example as data words each having 4, 8 or 16 bit data word width, a digital Zero can be assigned a first value of the control frequency and a digital One can be assigned a second value of the control frequency. The first and second values of the control frequency can be predefined as a constant or can be variable. For example, a digital Zero can be assigned a lower value of the control frequency and a digital One can be assigned a higher value of the control frequency or vice versa.

A change of the control frequency can be effected in a time period around the zero-crossing or at the zero-crossing of the AC mains voltage. For example, the time period can be defined by an absolute value of the AC mains voltage being lower than a predefined value during said period, for example lower than 25 V, in particular lower than 18 V. Such change prevents a disturbing noise development.

Depending on the data received, the receiver can send response data to the induction heating device. Due to the bidirectional data transmission, the induction heating device can send a specific request in terms of a dialog mechanism to the receiver which reacts with a specific response, for example by transmitting up-to-date sensor data. This way a small bandwidth available can be used in an optimized manner since not all data are transmitted permanently but only specifically required data is transmitted.

The induction heating device comprises: a resonant circuit having an induction heating coil and a converter which generates a control voltage from an AC mains voltage with at least one control frequency, wherein the resonant circuit is applied with a control voltage in order to generate an alternating magnetic field for heating a cooking vessel. The converter comprises a control unit which is configured to control the converter in such a way that the above mentioned method is conducted.

The inductively heatable cooking vessel may include a receiver which is configured to decode data transmitted via the above mentioned induction heating device by analyzing the control frequency. The inductively heatable cooking vessel can also include a sensor for detecting a parameter specific to a cooking vessel, for example for detecting a temperature of food prepared in the cooking vessel.

Turning now to the figures, FIG. 1 shows a system comprising an inductively heatable cooking vessel 9 as well as an induction heating device 1. The inductively heatable cooking vessel 9 has a receiver 10 arranged at a suitable location on the cooking vessel which is configured to receive data send by the induction heating device 1. Furthermore, the receiver 10 can optionally be configured to send data to the induction heating device 1, i.e. form a bidirectional transmitter/receiver, and/or to receive data from a temperature sensor 8 and to send said data to the induction heating device 1.

The temperature sensor 8 in the form of a conventional NTC temperature sensor is used to detect the temperature of cooked content which is heated by means of the cooking vessel 9, wherein the temperature sensor 8 is arranged in the cooking vessel 9, for example in a cavity (not shown) in the side walls or on the bottom of the cooking vessel 9 or on flexible feed lines freely moveable within the cooking vessel 9, for example in the form of a core temperature sensor.

The receiver 10 has an antenna in the form of a coil 7 which can be coupled inductively or magnetically to an induction heating coil 3 of the induction heating device 1 or which is coupled to said coil when used. An energy supply device of the receiver 10 in the form of a rectifier 11, for example in the form of a bridge rectifier, rectifies an output voltage of the coil 7. The rectified voltage UP supplies the receiver 10 with operating energy after being smoothened by a filter capacitor 12.

The receiver 10 further includes any suitable device or devices for changing the effective impedance of the coil 7 in the form of a switch 14, for example in the form of a transistor with a limiting choke 13 connected ahead, wherein the switch 14 is connected between connections of the coil 7 or the output of the rectifier 11. The receiver 10 further includes a voltage detector 16 for measuring a level of the rectified antenna voltage UP and a control device in the form of a micro controller 15 which is configured to conventionally determine data of the temperature sensor 8, for example by means of an analog digital (A/D) conversion, and to control the switch 14 in such a way that the impedance of the coil 7 is changed depending on the detected data of the sensor, in order to transmit the sensor data to the induction heating device 1. In this regard, see DE 10 2011 079 689 for further details.

The induction heating device 1 includes a resonant circuit 6 having an induction heating coil 3 and capacitors 4 and 5, wherein the capacitors 4 and 5 are conventionally connected between an intermediate circuit voltage UZK. A converter 2 generates from the AC mains voltage UN, for example by means of a half bridge, a control voltage UA with a variable control frequency, wherein the resonant circuit 6 is applied with the control voltage UA in order to generate an alternating magnetic field for heating the cooking vessel 9. The converter 2 includes a control device 2*a* which effects the encoding of data to be transmitted by a suitable change or selection of the control frequency so that data is transmitted to the receiver 10.

Figure 2:
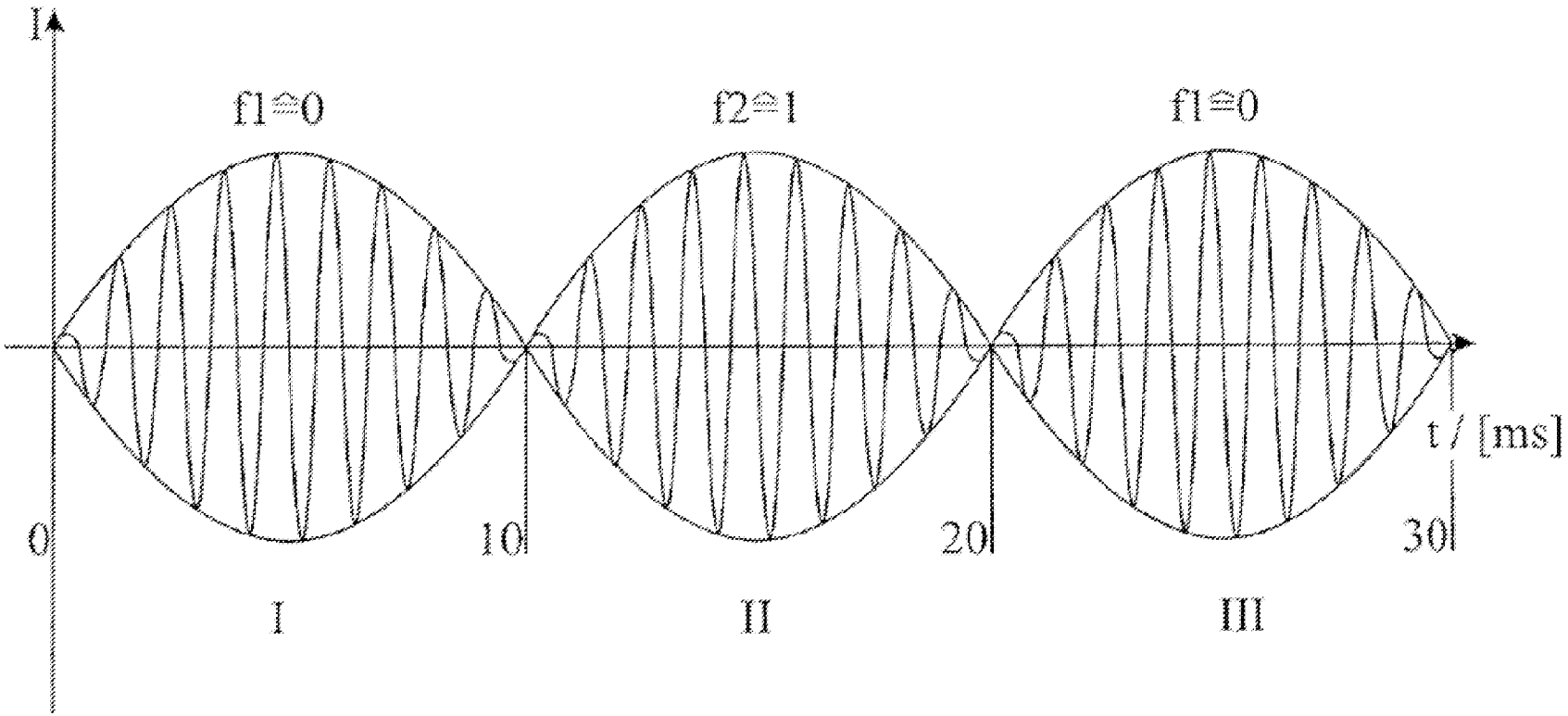

FIG. 2 shows a chronological sequence of a current I through the induction heating coil 3 as arising when transmitting data in the direction of the receiver 10 through a suitable generation of the control voltage UA. In a first time interval I the control voltage UA is generated as square wave voltage with a control frequency f1 of 24.0 kHz so that the inductor current I also has the control frequency f1 of 24.0 kHz where the AC mains voltage UA forms an amplitude. The control frequency f1 of 24.0 kHz encodes a binary "0". In the receiver 10, the control frequency is detected and a binary "0" is correspondingly decoded.

In a second time interval II the control voltage UA is generated as square wave voltage having a control frequency f2 of 24.2 kHz so that the inductor current I also has the control frequency f2 of 24.2 kHz, whereby the AC mains voltage forms an amplitude. The control frequency f2 of 24.2 kHz encodes a binary "1". In the receiver 10, the control frequency is detected and a binary "1" is correspondingly decoded. In a third time interval III the control voltage is generated again as a square wave voltage having the control frequency f1 of 24.0 kHz so that a binary "0" is decoded in the receiver 10.

Altogether, the result is a "010" bit string. It is logical that additional bits can be transmitted correspondingly. The data can, for example, be transmitted as 8 bit data words. Furthermore suitable synchronization signs can be encoded by means of suitable frequencies which, for example, mark the beginning of a data transmission or complete the data transmission.

A change between the control frequencies f1 and f2 is effected in each case at a zero-crossing of the AC mains voltage UN. Depending on the data received, the receiver 10 can transmit response data to the induction heating device 1. The transmission can be effected as described in the DE 10 2011 079 689.

The receiver 10 can be part of the cooking vessel 9 or can be detachably connected to the cooking vessel 9, whereby the coil 7 is provided on a bottom of the cooking vessel 9 and the remaining parts can, for example, be integrated into a handle (not shown) or a cavity of the cooking vessel 9 where they are protected against high temperatures. In case of a detachable connection, the receiver 10 or a part thereof can be integrated into a plastic frame which is plugged onto a conventional cooking vessel.

It is logical that, as an additional or alternative feature to the temperature sensors, sensors for further measurements can also be provided, for example pressure sensors in the case of vapor pressure cooking vessels and so forth.

To ensure that the capacity released to the cooking vessel 9 during data transmission in the direction of the receiver 10 changes as little as possible, it is favorable if the frequencies f1 and f2 lie close together. For example, this applies if f2 deviates only by about 1% from f1. Furthermore, in order to avoid audible interferences between several cooking zones, the frequency difference used should not exceed 400 Hz, better 200 Hz.

The change of the frequency may be effected exclusively at or in the vicinity of the zero-crossing of the alternating voltage supply UN. This measure also serves to prevent additional noises. It is generally not necessary to predefine the frequencies f1 and f2 as constants. The detection of a lower or higher frequency can also be effected dynamically.

The data transfer rate with the methods described without consideration of a protocol overhead may be in the range of about 100 bits per second. Generally also more than 2 control frequencies can be used, however, as a rule, 2 different frequencies will be sufficient in the case of binary data codes. Moreover, frequency distinction in the receiver electronics can be easier effected in the case of a limitation to 2 states.

In the case of a bidirectional data transmission, the available bandwidth can be better used in the sense of an interrogation-response mechanism, since by means of specific requests to the receiver 10 only the data is transferred from the receiver 10 to the induction heating device 1 that has previously been requested. Advantageous and preferable embodiments of the disclosure are the subject of the claims below. The wording of the claims is incorporated into the content of the description by explicit reference.

The invention claimed is:

1. A method for transmitting data from an induction heating device to a receiver of an inductively heatable cooking vessel, the method comprising:

utilizing a converter of the induction heating device to generate, from an AC mains voltage, a control voltage having a control frequency, the control frequency comprising a frequency shift keyed amplitude modulated signal;

applying the control voltage having the control frequency to a resonant circuit of the induction heating device;

in response to applying the control voltage to the resonant circuit, generating an alternating magnetic field for heating the inductively heatable cooking vessel;

changing the control frequency of the control voltage in a range of 0.1% to 5% with respect to a base frequency to generate at least two discrete control frequencies for encoding data to be transmitted via the control voltage having the at least two discrete control frequencies to a receiver of the inductively heatable cooking vessel; and transmitting the encoded data via the at least two discrete control frequencies of the control voltage to the receiver of the inductively heatable cooking vessel.

2. The method of claim 1, wherein the base frequency comprises a range of 20 kHz to 50 kHz.

3. The method of claim 1, wherein changing the control frequency is effected in a time period around the zero-crossing of the AC mains voltage, wherein the time period is defined by an absolute value of the AC mains voltage being lower than 25 V during said time period.

4. The method of claim 1, wherein transmitting the data comprises transmitting the data in binary code, wherein a digital Zero is assigned to a first control frequency of the at least two discrete control frequencies, and a digital One is assigned to a second control frequency of the at least two discrete control frequencies.

5. The method of claim 1, further comprising receiving response data from the receiver.

6. An induction heating device, comprising:

a resonant circuit comprising an induction heating coil; and a converter comprising a control unit and configured to generate, from an AC mains voltage, a control voltage having a control frequency, the control frequency comprising a frequency shift keyed amplitude modulated signal, to apply the control voltage having the control frequency to the resonant circuit such that an alternating magnetic field is generated for heating a cooking vessel, and to change the control frequency of the control voltage in a range of 0.1% to 5% with respect to a base frequency to generate at least two discrete control frequencies for encoding data to be transmitted via the control voltage having the at least two discrete control frequencies to a receiver of an inductively heatable cooking vessel.

7. The induction heating device of claim 6, wherein the base frequency comprises a range of 20 kHz to 50 kHz.

8. The induction heating device of claim 6, wherein changing the control frequency is effected in a time period around the zero-crossing of the AC mains voltage, wherein the time period is defined by an absolute value of the AC mains voltage being lower than 25 V during said time period.

9. The induction heating device of claim 6, wherein the control unit is further configured to transmit the data to a receiver of an inductively heatable cooking vessel in binary code, wherein a digital Zero is assigned to a first control frequency of the at least two discrete control frequencies, and a digital One is assigned to a second control frequency of the at least two discrete control frequencies.

10. An induction heating system, comprising:

an induction heating device comprising a resonant circuit comprising an induction heating coil, and a converter comprising a control unit and configured to generate, from an AC mains voltage, a control voltage having a control frequency, the control frequency comprising a frequency shift keyed amplitude modulated signal, to apply the control voltage having the control frequency to the resonant circuit such that an alternating magnetic field is generated for heating an inductively heatable cooking vessel, and to change the control frequency of the control voltage in a range of 0.1% to 5% with respect to a base frequency to generate at least two discrete control frequencies for encoding data to be transmitted via the control voltage having the at least two discrete control frequencies to a receiver of the inductively heatable cooking vessel; and the inductively heatable cooking vessel comprising a receiver configured to receive the encoded data via the at least two discrete control frequencies of the control voltage from the induction heating device and decode the encoded data by analysis of the at least two discrete control frequencies.

11. The induction heating system of claim 10, wherein the inductively heatable cooking vessel further comprises a sensor for detecting a parameter which is specific to the inductively heatable cooking vessel.

12. The induction heating system of claim 10, wherein the base frequency comprises a range of 20 kHz to 50 kHz.

13. The induction heating system of claim 10, wherein changing the control frequency is effected in a time period around the zero-crossing of the AC mains voltage, wherein the time period is defined by an absolute value of the AC mains voltage being lower than 25 V during said time period.

14. The induction heating system of claim 10, wherein transmitting the data comprises transmitting the data in binary code, wherein a digital Zero is assigned to a first control frequency of the at least two discrete control frequencies, and a digital One is assigned to a second control frequency of the at least two discrete control frequencies.

15. The induction heating system of claim 10, wherein the induction heating device is configured to receive response data from the receiver.

* * * * *